US007434365B2

(12) United States Patent
Geller

(10) Patent No.: US 7,434,365 B2
(45) Date of Patent: Oct. 14, 2008

(54) DRAWER OR DOOR FRONT ASSEMBLY

(76) Inventor: Gary Robert Geller, 15 SE. 15 Ave., Fort Lauderdale, FL (US) 33301

( * ) Notice: Subject to any disclaimer, the term of this patent is extended or adjusted under 35 U.S.C. 154(b) by 772 days.

(21) Appl. No.: 10/831,858

(22) Filed: Apr. 26, 2004

(65) Prior Publication Data

US 2005/0046318 A1 Mar. 3, 2005

Related U.S. Application Data

(60) Provisional application No. 60/499,670, filed on Sep. 3, 2003.

(51) Int. Cl.
*E04C 2/52* (2006.01)

(52) U.S. Cl. ..... 52/784.1; 52/784.12; 220/315

(58) Field of Classification Search ..... 52/784.1, 52/784.12, 783.1, 792.1, 212, 204.54, 792.11; 312/348, 263; 29/897.32; 220/315; 174/559, 174/DIG. 9, 560, 561, 562, 563
See application file for complete search history.

(56) References Cited

U.S. PATENT DOCUMENTS

| | | | | | |
|---|---|---|---|---|---|
| 997,677 | A | | 7/1911 | Ivey | |
| 1,848,715 | A | * | 3/1932 | Hart et al. | 52/784.13 |
| 2,912,725 | A | * | 11/1959 | Ries | 52/592.1 |
| 3,333,385 | A | | 8/1967 | King | |
| 3,524,691 | A | | 8/1970 | Moore | |
| 4,327,535 | A | | 5/1982 | Governale | |
| 4,387,545 | A | | 6/1983 | Kern | |
| 4,589,240 | A | * | 5/1986 | Kendall et al. | 52/309.11 |
| 5,161,870 | A | | 11/1992 | Mason et al. | |
| 5,384,103 | A | * | 1/1995 | Miller | 422/310 |
| 5,533,312 | A | * | 7/1996 | Mihalcheon | 52/309.9 |
| 5,644,870 | A | | 7/1997 | Chen | |
| 5,951,133 | A | | 9/1999 | Dittberner et al. | |
| 6,088,993 | A | | 7/2000 | Irace | |
| 6,099,095 | A | | 8/2000 | Irace | |
| 6,132,540 | A | | 10/2000 | Barber et al. | |
| 6,161,363 | A | * | 12/2000 | Herbst | 52/784.15 |
| 6,357,610 | B1 | | 3/2002 | Irace | |
| 6,449,916 | B1 | | 9/2002 | Waters | |
| 6,526,707 | B2 | | 3/2003 | Tucker | |
| 6,553,735 | B1 | | 4/2003 | Wang Chen | |
| 6,619,005 | B1 | | 9/2003 | Chen | |

(Continued)

*Primary Examiner*—Richard E. Chilcot, Jr.
*Assistant Examiner*—Anthony N Bartosik

(57) ABSTRACT

An interlocking drawer or door assembly has a rear panel and a front panel. The rear panel is a five sided box, four low walls surrounding a face. One or more apertures are formed in two or more of the walls, and a plastic rivet or other deformable member is located in each of the apertures, such that the head of the rivet is on the outside of the wall. The front panel is a similar five sided box, with each of the four corners laser welded to form a smooth and hidden seam. Each of the front panel walls has an additional portion that is bent 180 degrees toward the inside of the box to form a rolled wall that is parallel to and in close proximity to the wall. Holes are formed in the rolled wall to correspond to the location of respective deformable members in the rear panel. When the front and rear panels are assembled together with the open sides of the boxes facing each other, they create an interference fit between the deformable member and the holes so that the plastic rivet changes shape to partially conform to the shape of the aperture, to tightly retain the rear panel within the front panel.

20 Claims, 2 Drawing Sheets

U.S. PATENT DOCUMENTS 6,622,449 B2 9/2003 Smith et al.
6,691,483 B2 2/2004 Lethers
6,729,095 B2 5/2004 Wang Chen
6,931,810 B2 8/2005 Beaudoin et al.
7,100,342 B2 9/2006 Holloway

* cited by examiner

DRAWER OR DOOR FRONT ASSEMBLY

CROSS REFERENCE TO RELATED APPLICATION

This application is related to provisional application Ser. No. 60/499,670 entitled "DRAWER OR DOOR FRONT ASSEMBLY", filed Sep. 3, 2003, and applicant hereby claims priority right of said earlier filed provisional application.

BACKGROUND

Drawer and door fronts for cabinets, such as kitchen, bathroom or other storage units have traditionally been manufactured from wood, wood by-products, metal and/or plastic. Typically, these fronts are made from multiple pieces, fastened together using mechanical fasteners such as nails, screws, bolts, welds, adhesives, etc. This not only complicates the design of the door or drawer fronts, but adds to the material cost and the labor cost. In situations where metal is used to fabricate the door or drawer fronts, two panels, a front and a rear, are traditionally fastened together to create an assembly by spot-welding or using screw-type fasteners. The problem with each of these fastening methods is that, in addition to high labor costs, they leave obvious and unsightly evidence of their presence on the exterior of the door or drawer front, and that is unacceptable in many markets.

Additionally, when sheet metal is formed to create the panels of the door or drawer front, the juncture at the corners where the vertical walls of the panels meet leaves a gap that is also unsightly and undesirable. Some have chosen to arc or gas weld this joint, and then grind down the weld to attempt to create a visually pleasing joint, but even with the finest craftsmanship, the ground weld leaves evil notice of its presence. It would be a valuable addition to the art if a metal drawer or door front could be designed that would obviate the need for spot welding or screw fasteners, and that would have smooth and uniform corners to create an aesthetically pleasing and cost effective panel.

BRIEF DESCRIPTION OF THE DRAWINGS

The features of the invention, both as to organization and method of operation, together with objects and advantages thereof, may be best understood by reference to the following detailed description, which describes certain exemplary embodiments of the invention, taken in conjunction with the accompanying drawings in which.

DETAILED DESCRIPTION OF EXEMPLARY EMBODIMENTS

Figure 1:
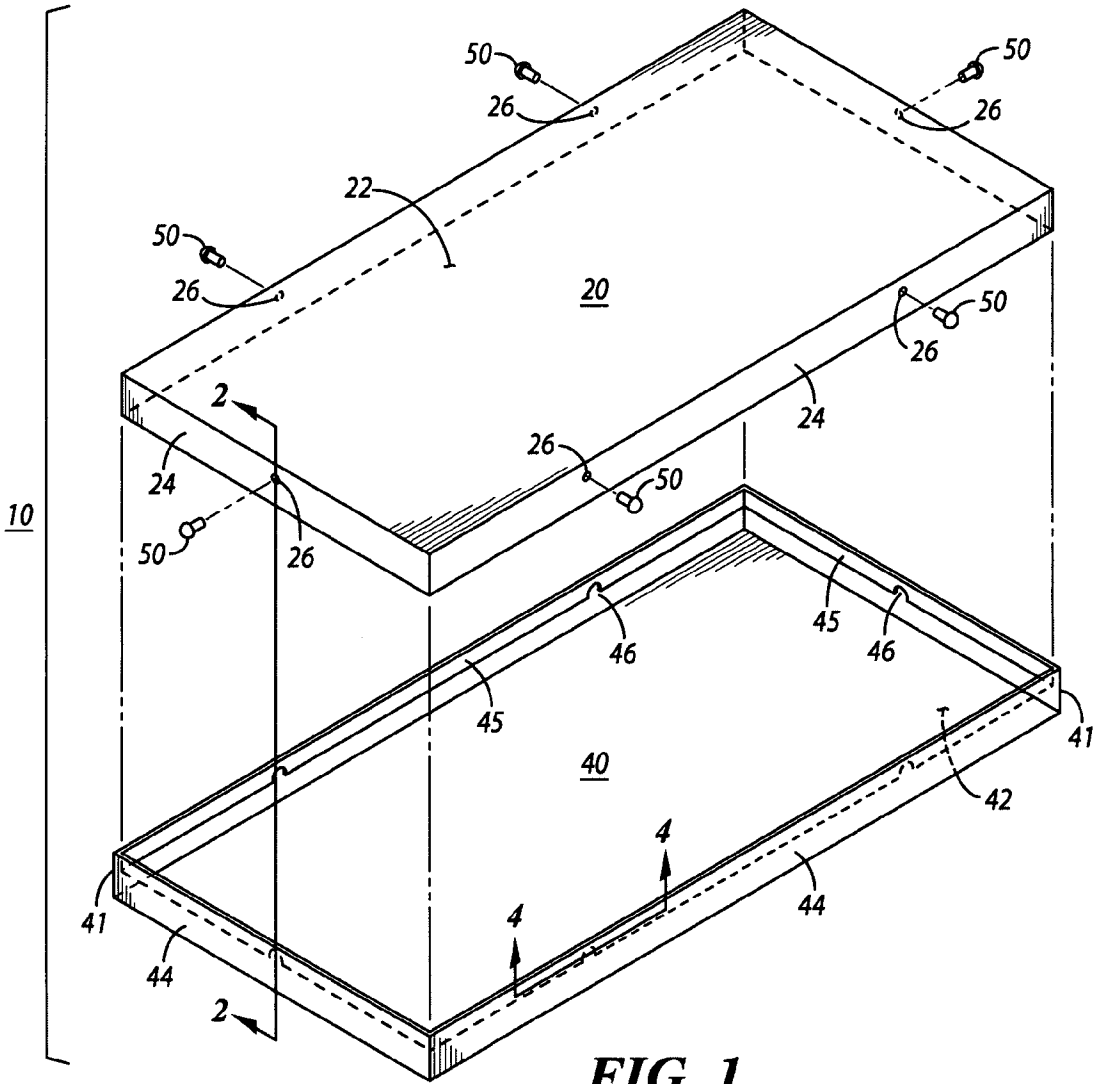
FIG. 1 is an exploded perspective view consistent with certain embodiments of the present invention.
Figure 2:
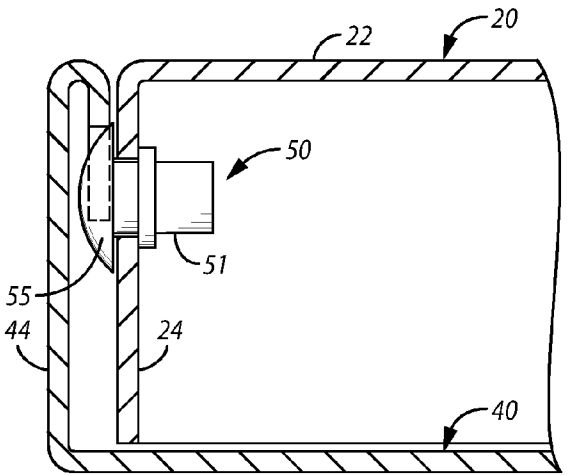
FIG. 2 is a cross-sectional view of FIG. 1, consistent with certain embodiments of the present invention.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals are used to describe the same, similar or corresponding elements in the several views of the drawings. Referring now to FIG. 1, an exploded perspective view, and FIG. 2, a cross sectional view of one embodiment of the invention, a drawer front assembly 10 or similar item consists of an outer or front panel 40 and an inner or rear panel 20. Although a drawer front assembly is used as an example to describe the invention, other types of assemblies can also utilize this technique, such as hinged doors, sliding doors, panels, shelves, etc, and still fall within the scope and spirit of the invention. Both the outer and inner panels 40, 20 are typically made of sheet metal, for example steel, stainless steel, aluminum, brass, or copper, and are formed to create a five sided rectangular box, with one side open to form a cavity. They are dimensioned so that the inner panel 20 nests inside of the cavity in the outer panel 40, with the open cavities of both the outer and inner panels facing each other. The inner panel 20 is formed to have a portion of each perimeter portion bent at a right angle to the major face 22 to form a wall 24 so that vertical edges of adjacent walls are in close proximity and form a seam at each corner. One or more holes or apertures 26 are formed at strategic locations on two or more of the walls 24 to subsequently receive the body 51 of a deformable member 50, such as a plastic rivet. The exact number and spacing of the apertures will, of course, vary with the dimensions of each unique drawer or door front, and a mechanical designer with ordinary skill in the art will understand that conventional design principles shall guide in the placement and number of the holes or apertures 26.

Figure 3:
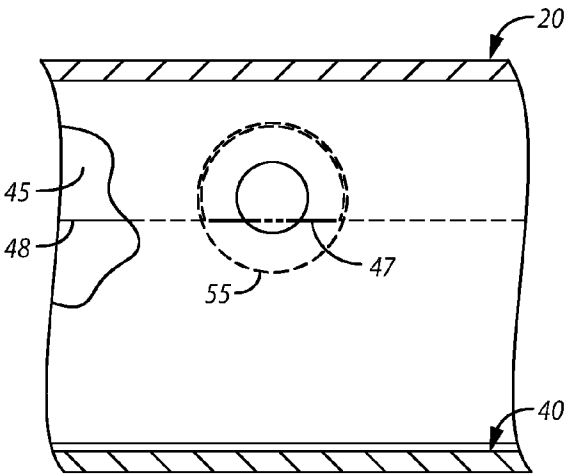
FIG. 3 is an elevational view of a portion of the assembly, viewed from the interior, consistent with certain embodiments of the present invention.
Figure 4:
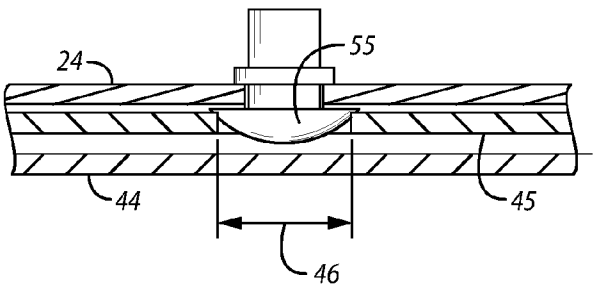
FIG. 4 is a cross-sectional view of FIG. 1, consistent with certain embodiments of the present invention.

The outer panel 40 is also formed so as to have a portion of each perimeter portion bent at a right angle to the major face 42 to form a wall 44. The walls 44 are formed such that the vertical edges of adjacent walls 44 are in close proximity and form a seam 41 at each corner, similar to the inner panel 20. However, unlike the inner panel, each wall 44 has an additional formed portion that is created by further bending an end portion of the wall 44 180° to create a 'rolled edge' or hem that faces the cavity side. The dimensions of the outer panel 40 are arranged so that the inner panel 20 will fit precisely into the cavity of the outer panel with little 'play' or interference. Generally, the designer will wish to have the major face 22 of the inner panel coplanar to the top of the rolled edge of the outer panel, as shown in the drawing figures, but other embodiments that place the major face above or below the rolled edge are also envisioned. Partial apertures 46 that have one portion of the perimeter of the aperture open, are formed in the rolled edge 45 at locations that correspond to the locations of the holes 26 in the inner panel. Referring now to FIG. 3, a chord 47 of the aperture is in line with the end 48 of the rolled edge 45 to create a shape that can capture the head of the deformable member 50. The diameter of the aperture 46 is dimensioned to be slightly smaller than the major diameter of the head 55 of the deformable member 50 so as to create an interference fit between the head of the deformable member 50 and the aperture, as shown in FIG. 4. A shaped aperture that is slightly larger than a semicircle is depicted in the drawings, but other shapes will occur to one skilled in the art, such as a semicircle, a square or rectangular aperture, a triangular aperture in the shape of an inverted 'V', or an aperture that is less than a semicircle.

One example of a deformable member 50 that I find suitable is a two-piece plastic snap rivet from McMaster Company, part number 91020A100, but other deformable members such as plastic screws, rubber plugs, bumpers, or buttons can be substituted. Referring again to FIGS. 1 and 2, the plastic rivets are inserted and secured into each of the holes 26 so that the head 55 of the rivet is on the outside of the inner panel 20. The drawer front assembly 10 is put together by inserting the inner panel 20 into the outer panel 40 to form a closed box such that the cavity sides of each panel face each other, and the major faces 22, 42 are on the outside of the assembly. Since the head 55 of the deformable member 50 is slightly larger than the partial aperture 46, the inner panel needs to be forced into the outer panel. The head 55 of each rivet deforms as it passes by the smaller apertures 46, locking the inner and outer panels securely together. The head of the rivet also causes the rolled edge 45 to deflect outward as the two panels are fit together, until such point when the head of the rivet passes the smooth metal and 'falls' into the aperture 46, whereupon the rolled edge 45 deflects back into the original position.

In order to create an assembly that is dimensionally accurate, pleasing to the eye and tight fitting, the various features of each of the panels 20, 40 are created by cutting with a laser, as opposed to stamping, drilling or other mechanical cutting procedures. In addition, the seam at the outside corners 41 of the outer panel 40 is welded with a pulsed YAG laser. Laser welding produces a corner that needs little, if any, subsequent cleaning or polishing operations, and is mechanically solid, precise, and pleasing to the eye. Pulsed YAG lasers are preferred over $CO_2$ lasers because they can produce a smaller and cleaner weld without the heat buildup and subsequent puddling, voiding and distortion that occurs when using $CO_2$ lasers or conventional welding. The seams at the inside corners of the rolled edges 45 need not be welded, but if desired, one can also laser weld them using the same YAG laser techniques. I have found that the corners of the inner panel 20 do not need to be laser welded, in contrast, when they are not welded or otherwise fastened together they have additional compliance, which aids in fitting the two panels together.

In summary, without intending to limit the scope of the invention, a drawer or door front assembly according to certain embodiments of the invention can be carried out by using deformable plastic rivets to capture an inner sheet metal panel in a laser welded outer sheet metal panel. Those skilled in the art will recognize that the present invention has been described in terms of exemplary embodiments based upon use of plastic rivet heads captured in semicircles cut in stainless steel panels. While the invention has been described in conjunction with specific embodiments, it is evident that many alternatives, modifications, permutations and variations will become apparent to those of ordinary skill in the art in light of the foregoing description.

What is claimed is:

1. An interlocking drawer or door assembly, comprising:

a first panel formed to create a five sided box comprising a major plane and four walls, each wall at a right angle to the major plane;

one or more apertures in each of two or more of the walls;

a member having a deformable head portion, disposed in each of said apertures in said first panel such that said head portion is on an exterior side of said five sided box;

a second panel formed to create a five sided box comprising a major plane and four walls, each wall at a right angle to the major plane forming four corners each having a laser welded seam, and each of said walls having an additional portion bent 180 degrees inwardly to the box to be parallel to and in close proximity to said wall;

partial apertures formed in said additional portion of said second panel such that at least one portion of a perimeter of said partial apertures is open and facing said major plane of said second panel, and;

wherein said first panel is retained inside said second panel such that the deformable head portion of each member is captured in a respective partial apertures.

2. The assembly as described in claim 1, wherein said member is selected from the group consisting of a plastic rivet, a plastic screw, a rubber plug, a bumper or a button.

3. The assembly as described in claim 1, wherein said four corners are pulsed YAG laser welded.

4. The assembly as described in claim 1, wherein said partial aperture is selected from the group consisting of a semicircle, a square, a rectangle, a triangle, or a portion of a circle.

5. The assembly as described in claim 4, wherein said partial aperture is smaller than said deformable head portion.

6. The assembly as described in claim 1, wherein each of the five sided boxes comprises an open cavity, and the open cavities of each of said first and second panels face each other.

7. An interlocking drawer or door assembly, comprising:

a first panel comprising a five sided box, having a major plane and four perimeter walls at right angles to the major plane, two or more of the walls having one or more apertures therein;

a second panel comprising a five sided box having a major plane and four perimeter walls at right angles to the major plane, two or more of the walls having one or more apertures therein corresponding to the apertures in the first panel, the first and second panels positioned opposite to each other;

members having a body portion and a deformable head portion, the body portion disposed in said apertures of said first panel; and said first panel assembled to and retained within said second panel by means of the deformable head portion deforming so as to be captured in a respective aperture in said second panel.

8. The assembly as described in claim 7, wherein said member is selected from the group consisting of a plastic rivet, a plastic screw, a rubber plug, a bumper or a button.

9. The assembly as described in claim 7, wherein said walls of said second panel are laser welded where they meet at corners of the box.

10. The assembly as described in claim 9, wherein said laser is a pulsed YAG laser.

11. The assembly as described in claim 7, wherein said aperture in said second panel wall is selected from the group consisting of a semicircle, a square, a rectangle, a triangle, or a portion of a circle.

12. The assembly as described in claim 11, wherein said aperture is a partial aperture.

13. The assembly as described in claim 7, wherein each of said five sided boxes comprises an open cavity, and the open cavities of each of said first and second panels face each other.

14. The assembly as described in claim 7, wherein the head portion is larger than the body portion, the body portion disposed in said aperture in said first panel and the head portion on an exterior face of said five sided box.

15. The assembly as described in claim 7, wherein said member distorts and changes shape to at least partially conform to the shape of the capturing aperture when the first panel is assembled to the second panel.

16. An interlocking drawer or door assembly, comprising:

a front panel having a major face and a perimeter wall, portions of the perimeter wall having a laser welded seam and having one or more recesses therein;

a rear panel having a major face and a perimeter wall, arranged to fit within the front panel, a deformable fastening means having a body portion and a deformable head portion, the head portion situated on an exterior side of the rear panel perimeter wall and the body portion situated in the rear panel perimeter wall;

the rear panel inserted into the front panel such that the deformable head portion distorts so as to be captured by the one or more recesses to tightly retain the panels together.

17. An interlocking drawer or door assembly, comprising:

a first panel formed to create a five sided box comprising a major plane and four walls, each wall at a right angle to the major plane;

one or more apertures in each of two or more of the walls;

a member having a deformable head portion, disposed in each of said apertures in said first panel such that said head portion is on an exterior side of said five sided box;

a second panel formed to create a five sided box comprising a major plane and four walls, each wall at a right angle to the major plane forming four corners each having a laser welded seam, and each of said walls having an additional portion bent 180 degrees inwardly to the box to be parallel to and in close proximity to said wall;

partial apertures formed in said additional portion of said second panel such that at least one portion of a perimeter of said partial apertures is open and facing said major plane of said second panel, and;

said first and second panels formed to comprise an interference fit between the deformable head portion and the partial apertures when said first and second panels are assembled with open cavities facing each other, such that the deformable head portion of each member deforms and is captured in a respective partial apertures.

18. The assembly as described in claim 17, wherein said member is selected from the group consisting of a plastic rivet, a plastic screw, a rubber plug, a bumper or a button.

19. The assembly as described in claim 17, wherein said partial aperture is selected from the group consisting of a semicircle, a square, a rectangle, a triangle, or a portion of a circle.

20. The assembly as described in claim 17, wherein said first and second panels comprise sheet metal.

* * * * *